US009125493B2

(12) United States Patent
Siekman et al.

(10) Patent No.: US 9,125,493 B2
(45) Date of Patent: Sep. 8, 2015

(54) SEAT CUSHION WITH FLEXIBLE CONTOURING

(71) Applicant: Seettek, LLC, Zionsville, IN (US)

(72) Inventors: Allen Siekman, Ben Lomond, CA (US); Peter C. Prust, Carmel, IN (US)

(73) Assignee: Backjoy Orthotics, LLC, Boulder, CO (US)

( * ) Notice: Subject to any disclaimer, the term of this patent is extended or adjusted under 35 U.S.C. 154(b) by 29 days.

(21) Appl. No.: 13/755,959

(22) Filed: Jan. 31, 2013

(65) Prior Publication Data

US 2013/0193738 A1 Aug. 1, 2013

Related U.S. Application Data

(60) Provisional application No. 61/593,155, filed on Jan. 31, 2012.

(51) Int. Cl.
*A47C 7/18* (2006.01)
*A47C 7/02* (2006.01)

(52) U.S. Cl.
CPC . *A47C 7/02* (2013.01); *A47C 7/021* (2013.01); *A47C 7/022* (2013.01)

(58) Field of Classification Search
CPC ..... A47C 7/022; A47C 23/002; A47C 7/18; A61G 5/1043; B60N 2/7035; B32B 3/30
USPC ..... 297/452.21, 452.26; 5/653
See application file for complete search history.

(56) References Cited

U.S. PATENT DOCUMENTS

| | | | |
|---|---|---|---|
| 1,296,359 | A | 3/1919 | Brown |
| 1,922,228 | A | 8/1933 | Brown |
| 1,982,516 | A | 11/1934 | Holmested |
| 2,082,151 | A | 6/1937 | De Poix |

(Continued)

FOREIGN PATENT DOCUMENTS

| | | |
|---|---|---|
| GB | 2274054 | 7/1994 |
| JP | 2005-95472 | 4/2005 |

(Continued)

OTHER PUBLICATIONS

International Search Report and Written Opinion; PCT/US2013/024008; mailed Aug. 5, 2013.

(Continued)

*Primary Examiner* — Sarah B McPartlin
(74) *Attorney, Agent, or Firm* — Brooks Acordia IP Law, PC; Michael Zarrabian

(57) ABSTRACT

A cushion for supporting a user relative to a support surface is provided. The cushion has material with sufficient flexibility to deform under a weight of the user and sufficient resilience to return to its original state when the weight is removed. A supporting face contacts the support surface and is characterized by a plurality of points. The supporting face is contoured such that, when the cushion is in an unloaded configuration, a first subset of the plurality of points contact the support surface and a second subset of the plurality of points do not contact the support surface. When a user then sits on the cushion so that it is in a loaded configuration, at least some of the points in the second subset are displaced under the user's weight and contact the support surface. The cushion thus both bends and compresses to distribute the weight of the user.

14 Claims, 3 Drawing Sheets

(56) References Cited

U.S. PATENT DOCUMENTS

| | | | | |
|---|---|---|---|---|
| 2,434,641 | A | | 1/1948 | Burns |
| 2,552,039 | A | * | 5/1951 | Flogaus ..... 297/452.26 |
| 3,148,390 | A | * | 9/1964 | Vakousky ..... 441/127 |
| 3,231,454 | A | | 1/1966 | Williams |
| 3,468,311 | A | | 9/1969 | Gallagher |
| 3,514,156 | A | | 5/1970 | Fields |
| 3,553,748 | A | | 1/1971 | Ross |
| 3,605,145 | A | | 9/1971 | Graebe |
| 4,070,719 | A | | 1/1978 | Morgan |
| 4,143,916 | A | | 3/1979 | Trotman et al. |
| 4,194,255 | A | | 3/1980 | Poppe |
| 4,205,880 | A | | 6/1980 | Trotman et al. |
| D262,590 | S | | 1/1982 | Trotman et al. |
| 4,435,015 | A | | 3/1984 | Trotman et al. |
| 4,529,248 | A | | 7/1985 | Trotman et al. |
| 4,605,582 | A | | 8/1986 | Sias et al. |
| 4,673,452 | A | | 6/1987 | Awdhan |
| 4,673,605 | A | | 6/1987 | Sias et al. |
| 4,686,724 | A | | 8/1987 | Bedford |
| 4,698,864 | A | * | 10/1987 | Graebe ..... 5/654 |
| D294,212 | S | | 2/1988 | Sias et al. |
| 4,866,800 | A | | 9/1989 | Bedford |
| 4,892,353 | A | | 1/1990 | Goddard |
| 4,989,284 | A | | 2/1991 | Gamm |
| 5,010,609 | A | | 4/1991 | Farley |
| 5,015,037 | A | | 5/1991 | Giblin et al. |
| D323,092 | S | | 1/1992 | Fenner, Sr. |
| 5,079,790 | A | | 1/1992 | Pouch |
| D329,566 | S | | 9/1992 | Davidson, Jr. |
| 5,158,073 | A | * | 10/1992 | Bukowski ..... 601/28 |
| 5,160,785 | A | | 11/1992 | Davidson, Jr. |
| 5,243,722 | A | | 9/1993 | Gusakov |
| 5,286,089 | A | | 2/1994 | Goldman |
| D345,072 | S | | 3/1994 | Rose et al. |
| 5,294,181 | A | | 3/1994 | Rose et al. |
| 5,325,552 | A | | 7/1994 | Fong |
| D355,558 | S | | 2/1995 | Graebe |
| 5,402,545 | A | | 4/1995 | Jolley |
| 5,411,318 | A | | 5/1995 | Law |
| 5,444,881 | A | | 8/1995 | Landi et al. |
| 5,459,896 | A | | 10/1995 | Raburn et al. |
| D372,157 | S | | 7/1996 | Bonaddio et al. |
| D375,863 | S | | 11/1996 | Bigolin |
| 5,607,749 | A | | 3/1997 | Strumor |
| D378,968 | S | | 4/1997 | Martin et al. |
| 5,628,079 | A | | 5/1997 | Kizemchuk et al. |
| 5,645,314 | A | | 7/1997 | Liou |
| 5,692,952 | A | | 12/1997 | Chih-Hung |
| D389,692 | S | | 1/1998 | Graebe et al. |
| D389,702 | S | | 1/1998 | Graebe et al. |
| D391,110 | S | | 2/1998 | Graebe |
| 5,749,111 | A | | 5/1998 | Pearce |
| 6,009,578 | A | | 1/2000 | Davis |
| 6,018,832 | A | | 2/2000 | Graebe |
| D449,170 | S | | 10/2001 | Kim |
| 6,701,556 | B2 | | 3/2004 | Romano et al. |
| 6,726,285 | B2 | | 4/2004 | Caruso et al. |
| D497,761 | S | | 11/2004 | Martin |
| 6,818,676 | B2 | | 11/2004 | Koffler et al. |
| 6,901,617 | B2 | | 6/2005 | Sprouse, II et al. |
| 6,938,290 | B2 | | 9/2005 | McKinney et al. |
| 7,083,236 | B1 | | 8/2006 | Smith |
| 7,120,956 | B1 | | 10/2006 | Liao |
| 7,695,069 | B2 | | 4/2010 | Prust |
| 2002/0013407 | A1 | | 1/2002 | Pearce |
| 2002/0185898 | A1 | | 12/2002 | Smith |
| 2003/0037377 | A1 | | 2/2003 | Kawamura et al. |
| 2004/0098806 | A1 | | 5/2004 | Stender et al. |
| 2005/0022305 | A1 | | 2/2005 | Bieganek et al. |
| 2005/0235423 | A1 | | 10/2005 | Hetzel et al. |
| 2008/0016622 | A1 | | 1/2008 | Prust |
| 2010/0295221 | A1 | | 11/2010 | Kligerman et al. |
| 2012/0180199 | A1 | | 7/2012 | Chilson et al. |

FOREIGN PATENT DOCUMENTS

| | | |
|---|---|---|
| JP | 2006095101 | 4/2006 |
| JP | 2009-406 | 1/2009 |
| WO | 98/04170 | 2/1998 |
| WO | 2006/037970 | 4/2006 |
| WO | 2008011488 | 1/2008 |
| WO | WO-2013116438 A2 | 8/2013 |
| WO | WO-2013116438 A3 | 9/2013 |

OTHER PUBLICATIONS

Posey® Foam Heel Guards—6127, 6145, 6145BT. Posey Company. Mar. 6, 2013. <URL: http://www.posey.com/files/M6011-Posey%C2%AE-Foam-Heel-Guards.pdb(retrieved on Jun. 5, 2014).

International Search Report and Written Opinion for PCT/US2014/022132, mailed Jun. 23, 2014.

* cited by examiner

SEAT CUSHION WITH FLEXIBLE CONTOURING

CROSS-REFERENCES TO RELATED APPLICATIONS

This application claims the benefit of U.S. Provisional Application No. 61/593,155, entitled "SEAT CUSHION WITH FLEXIBLE CONTOURING," filed Jan. 31, 2012, the entire disclosure of which is hereby incorporated herein by reference.

BACKGROUND OF THE INVENTION

The human body was not designed for sitting. Humans are designed to ambulate on two legs with the makeup of the skeletal support within the body designed for walking That being the case, humans do spend a lot of time sitting and a significant number are not able to stand or walk due to accident, disease or age related limitations. People that sit for a large portion of time during the day may require specialized seating to provide increased comfort, controlled posture or protection from the development of decubitus ulcers (also known as bed sores or pressure sores).

Relevant Anatomy

FIG. 1A is a side view of a prior art seated person showing primary anatomical areas of the pelvis supporting the person while sitting. It show the primary anatomical areas of the pelvis that are important in describing how prior art and the current cushions function. There are several primary areas that are important relative to support of the pelvis and the upper torso of a person when in a seated position. The areas that are in contact with the seat cushion are the most important for this discussion. They are formed by a combination of the skeletal components and are of course surrounded by layers of soft tissue resulting in the familiar shapes of the buttocks and thigh.

The skeletal components most associated with supporting the body in a seated posture include the ischial tuberosities 101, greater and lesser trochanter 102 (at the hip Joint) and the long bone of the femur 103. The long bone of the femur 103 and trochanter 102 form the trochanteric shelf 104, an ideal place to shift load for pressure relief at the ischials 101 or coccyx 108 and to also improve lateral stability for the pelvis 100.

The first areas of concern are the two ischial tuberosities (ITs) 101. The IT 101 area of the pelvis 100 is the lowest point of the pelvis 100 when in a seated position. Viewed from the side, the ITs 101 are lower than the hip joint 105. In the average adult, the distance between the lowest point of the ITs 101 and the lowest part of the hip joint 105, the trochanter 102, is approximately 40 mm (1.57"). In addition to being lower, the ITs 101 have very sharp pointed contours. When in the seated posture with the feet supported on the floor, or on wheelchair footrests and the arms supported on armrests, the buttocks 106 and posterior thigh 107 will support approximately 65% of a person's body weight. As an example, a 200-pound person will have 130 pounds of weight distributed on the buttocks and posterior thigh with the peak pressures centered on the IT 101 area. Approximately 80% of all pressure sores for wheelchair users occur at the ischial tuberosities 101.

Another area of possible contact in the seated position is the sacrum and coccyx (tailbone) 108. The coccyx 108 is another sharp bony prominence that is not ideally suited for significant weight bearing and is also an area of increased risk for pressure sores. The coccyx 108 is higher than the ischials so the risk of pressure sores there is not as high as at the ITs unless the person sits in a "slouched" posture, but the risk is still significant.

A further concern is lateral stability of the pelvis 100. The spine 110 has a normal natural curvature at which the muscles supporting it need to do the least amount of work as shown in FIG. 1B, where a user is sitting on a cushion as in present embodiments (i.e., FIG. 1B is not prior art). This normal curvature is generally found when the person is walking with proper posture, standing up straight, or sitting up straight. However, all people tend to slouch or relax their posture at least slightly upon sitting down. As seen in FIG. 1A, this causes pelvic retrusion, where the pelvis 100 rotates slightly backward, causing the bottom of the pelvis 100 to move in an anterior direction, the top of the pelvis 100 to move in a posterior direction, or some combination of both movements. Since the spine 110 is attached to the pelvis 100, this pelvic retrusion causes the spine 100 to straighten and undergo a change in alignment of various vertebrae 111 away from the normal curvature of spine 110. As a result, muscles react between vertebrae in the spine, activating to urge the vertebrae back toward normal alignment. This muscle activation lasts the entire time the misalignment persists. The muscles thus must work harder to support the spine in this misaligned position, leading to muscle fatigue. The muscles may also experience further strain due to pressure exerted between misaligned vertebrae. The muscle fatigue and strain resulting from misalignment can lead to substantial lower back pain.

Prior Art Cushion Designs

Prior art wheelchair seat cushions come in a wide variety of designs, from a simple piece of polyurethane foam to very complex cushions with multiple density foams, foam and flexible gel layers or fluid bladders (air and/or viscous fluid). However, two primary design considerations are common to all cushions regardless of specific variety: heat buildup and pressure distribution.

Heat build-up in cushions is a design consideration because the support medium and cover materials used in wheelchair seat cushions may act as good insulators. The human body is warmer than average room temperature creating a situation where the heat of the body starts to warm the cushion when a person sits down. Since the cushion acts like an insulator, the heat is deflected back up to the body creating a rise in skin temperature. In a room at a customary ambient temperature of approximately 22° C. (72° F.), average skin temperature is about 24° C. Skin temperature at the seat cushion interface usually reaches 35°-37° C. in 60-120 minutes. As skin temperature increases to around 31° C. the body responds by increasing sweating in an effort to control heat buildup and maintain a constant core temperature. The point at which the body triggers this sweating is called the perspiration threshold. Moisture is caused by the skin reaching the perspiration threshold, triggered by heat.

Heat build-up and sticking clothing can be annoying, but for most people, it does not pose a serious health risk. However, for people that use wheelchair cushions, heat build-up is a primary factor for increased risk of developing pressure sores. The top three contributing factors are peak pressure at areas of high risk, heat, and moisture. Pressure applied to the skin and soft tissue closes off the capillaries and the soft tissue can die from lack of oxygen and/or nutrients. Moisture softens the skin and makes it more susceptible to physical damage. Heat causes a rather dramatic increase in cellular metabolism. As skin temperature increases 1° C., the metabolic demand increases 10%. The increase in metabolism means that the cells need more oxygen as the temperature increases and the soft tissue can die from lack of oxygen.

Since skin temperature dramatically affects skin integrity, it is very important to prevent skin temperature build-up in wheelchair cushions.

To address the pressure issue, most cushions support the body by allowing the body mass to sink into or immerse into the cushion. The first points of contact are the ischials. Cushions that are successful in providing comfort and decreasing the risk of pressure sore development thus all have a common design requirement of redistributing pressure away from the sharp boney prominences of the ischials and shifting those pressures to the rest of the seated support surface at the hips and trochanteric shelf There are three ways in which a cushion can support a person. The most common is that the shape of the cushion changes with the applied load. The vast majority of cushions work in this way. Cushions made from resilient foams will compress allowing the body to sink into or immerse into the cushion. This allows the cushion to change shape and adapt to the user. Some cushions have a fluid interface with the user. In this configuration, the fluid will move out of the way of high pressure and flow to areas of low pressure as it attempts to equalize support.

The key to the function of these cushions is that the material used to fabricate the cushions has the ability to change shape under load. The foam compresses or the fluid moves. When foam is compressed the elastic properties of the foam offer some resistance to compression as it changes from a flat sheet to a contoured surface. The resilient nature of the foam behaves like a series of springs standing on their ends, much like a mattress is constructed. As load is applied to a foam wheelchair cushion the first "springs" that would be compressed would be the ones under the IT areas and they would compress the furthest as load is applied over the entire cushion surface. Coil springs increase resistance the further they are compressed. The spring-like quality of polyurethane foam responds the same way. The pressure required to compress the foam increases as the foam is compressed. Since the foam is compressed the most under the ischials, the pressure is greater at those areas.

Another way to achieve the same type of pressure distribution and comfort is to design the cushion with a fluid interface. A fluid interface could either be a gas or liquid. Both materials are fluid in while different in physical properties. It is the nature of a fluid to move away from areas of high pressure and move to areas of low pressure. This allows the fluid cushion interface to allow immersion but also to provide greater levels of envelopment as the cushion forms to the shape of an object pushing against it. Cushions fabricated with multiple air bladders may have all of the air bladders interconnected. When a person sits on such a cushion, the air (gaseous fluid) is moved away from areas of high pressure and travels to areas of low pressure. This tends to equalize the pressure over the complete seating surface area and reduces peak pressure at areas of high risk. Fluid cushions that use a liquid instead of a gas follow the same laws of physics and will also move away from areas of high pressure and fill in areas of low pressure. Due to the higher viscosity of most fluids as compared to gases, liquid fluid cushions tend to adapt to the shape of the user slower than air filled cushions. This may improve stability, but the pressure relief principles are the same.

A second type of wheelchair cushion combines the resilient materials (foam or fluids) with a cushion shape that is pre-contoured to match a generic anatomical shape of a seated person. As an example, when a person sits on a soft moldable surface like sand or snow and then carefully gets up, there will be an imprint in that soft substrate that represents a normal anatomical shape. The contours will be lower underneath the IT area and will round upwards around the buttocks and will have two elongated troughs where the surface was compressed by the thighs. One of the ways to reduce the peak pressure build up under the IT area and to provide more comfort overall is to pre-contour the cushion so that the cushion does not have a flat top surface. This allows the cushion supporting the body by starting out with a shape that closely matches a general human anatomy. A cushion is pre-contoured if it is fabricated with a top shape that mimics the same general shape of the buttocks and thighs that is found in a seated person. When a cushion has this generic pre-contoured configuration, the support medium does not have to compress as much to match the shape of the user and pressures can be redistributed to the trochanteric shelf and away from the ischials more efficiently.

A related method for transferring load away from the areas of peak pressure and improving pressure distribution and comfort is to fabricate the cushion from a variety of materials that provide a firmer surface underneath the trochanteric shelf and a softer surface underneath the ischial area. Using this multi-Density foam technique is rather common in the wheelchair cushion industry. This can be done with a flat or pre-contoured cushion but still relies on the same principles of cushion support outlined above.

A third method of redistributing pressure is to fabricate the cushion to the exact shape of the individual user. In this technique, the person is positioned on a cushion that has been molded to their specific shape and posture. There are several techniques to accomplish this but the end result is that the cushion and person have the same shape. Because the dimensional differences between the ischials and trochanteric shelf are addressed and there is a lot of surface area bearing load, there is usually little need for the cushion to change shape or allow immersion to accommodate the boney prominences of the user. This technique is very good, but the process can be time consuming and very expensive and is prone to fitment problems if the user grows or changes shape by gaining or losing weight.

BRIEF SUMMARY OF THE INVENTION

The following presents a simplified summary of some embodiments of the invention in order to provide a basic understanding of the invention. This summary is not an extensive overview of the invention. It is not intended to identify key/critical elements of the invention or to delineate the scope of the invention. Its sole purpose is to present some embodiments of the invention in a simplified form as a prelude to the more detailed description that is presented later.

Cushions for supporting a user relative to a support surface and having a dynamic response to loading including both bending and compressing are disclosed.

In one embodiment, a cushion for supporting at least a portion of a user's body relative to a support surface is provided. Before a user places his or her weight on the cushion by sitting on it, the cushion is in an unloaded configuration. Once the user places his or her weight on the cushion by sitting on it, the cushion is in a loaded configuration. The cushion has material with sufficient flexibility for the cushion to deform from this unloaded configuration toward the loaded configuration when the load of the user's weight is placed on the cushion. The cushion also has sufficient resilience to return from the loaded configuration toward the unloaded configuration when the user gets up and the weight of the user is removed from the cushion. The cushion can be separated into three main parts: a body, a sitting face on the top side of the body, and a supporting face on the underside of the body. The sitting face is the part of the cushion which will actually contact the supported portions of the user's body when the user is supported by the cushion. The supporting face contacts the support surface and can be characterized by a plurality of points. The supporting face can also be contoured such that, when the cushion is in the unloaded configuration, a first subset of the plurality of points contact the support surface and a second subset of the plurality of points do not contact the support surface. When a user then sits on the cushion so that it is in the loaded configuration, at least some of the points in the second subset are displaced under the user's weight and contact the support surface.

In many embodiments the supporting face of the cushion further comprises a plurality of pillars. Each pillar has a top end connected to the body of the cushion and a bottom end corresponding to one of the plurality of points. In the cushion's unloaded state, some pillars do not touch the support surface. These pillars correspond to the second subset of the plurality of points, and they are shorter than the pillars corresponding to the first subset of the plurality of points, which do touch the ground when the cushion is in its unloaded state.

In embodiments, the pillars corresponding to the second subset are shortest underneath an area of the cushion designed for receiving the ischial tuberosities of the user. In embodiments, the second subset pillars increase in height as pillar placement on the supporting face moves away from an area of the cushion designed for receiving the ischial tuberosities of the user.

In embodiments, as the weight of the user is placed on the cushion, the cushion body is sufficiently flexible so that the cushion bends while deforming toward the loaded configuration, and the material is sufficiently compressible so that it also compresses in distributing a weight of the user. In some embodiments, the cushion first bends to match the contour of the user's body while deforming toward the loaded configuration and then compresses to support and distribute the weight of the user.

In some embodiments, the cushion body, sitting face, and supporting face are made of one piece by injection molding. In some embodiments, the cushion contains material that is single density, closed-cell foam, such as ethylene-vinyl acetate (EVA) foam.

The cushion can also have a sitting face with a contour configured to match a generic anatomical shape of a seated user. The contour can include a recessed area configured to receive a pelvis and coccyx of the user, and/or elevated components to support and orient thighs and hips of the user.

In some embodiments, the supporting face has troughs between the pillars such that surface tension on the supporting face is decreased to lower a magnitude of a force needed for bending or compressing the cushion near the troughs. In some embodiments, the troughs are rounded. In some embodiments, the troughs are positioned in a row and column pattern. In some embodiments, the troughs are positioned only in locations of maximum surface tension. In some embodiments, the troughs extend over the entirety of the supporting face.

In some embodiments, the cushion has ports which provide openings extending through the seating face, the body, and the supporting face.

In some embodiments, a cushion is configured for a method for supporting at least a body part of a person. The method involves, in response to receiving a first portion of a weight of at least the body part of a person on the cushion, bending and changing shape of the cushion to conform to a contour of the body part. The method also involves, in response to receiving a second portion of weight of at least the body part of the person on the cushion, compressing the material in the cushion according to the distribution of the load, wherein the combination of the change of shape and compression of the cushion act to redistribute pressure against at least the body part supported by the cushion.

For a fuller understanding of the nature and advantages of the present invention, reference should be made to the ensuing detailed description and accompanying drawings.

DETAILED DESCRIPTION OF THE INVENTION

Figure 1B:
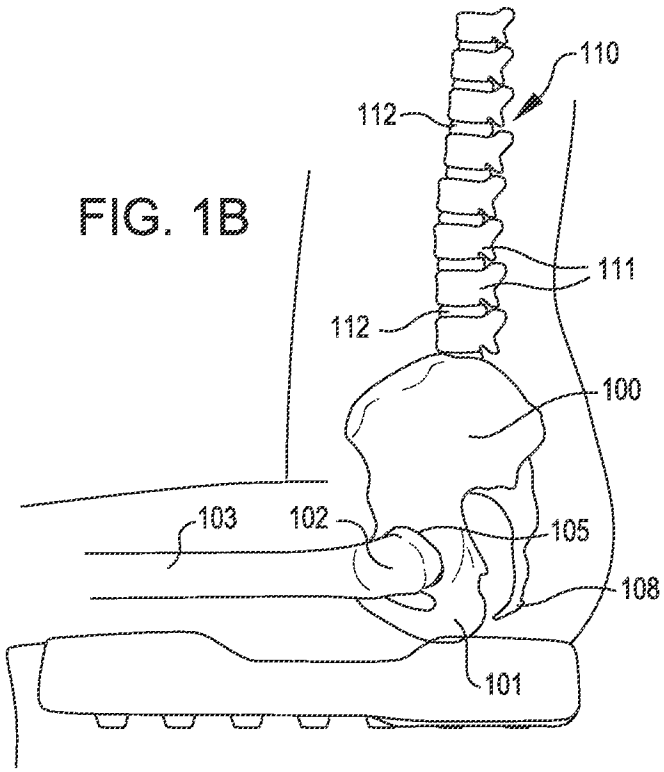
FIG. 1B is a side view of a seated person showing primary anatomical areas of the pelvis supporting the person while sitting on a cushion in accordance with various embodiments.
Figure 1A:
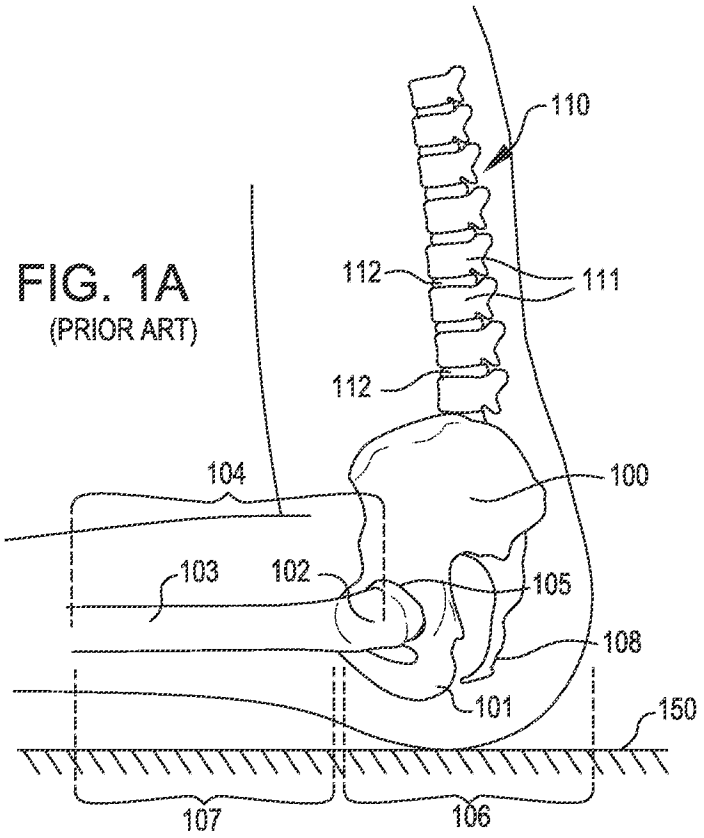
FIG. 1A (PRIOR ART)
FIG. 1A is a side view of a prior art seated person showing primary anatomical areas of the pelvis supporting the person while sitting.

In the following description, various embodiments of the present invention will be described. For purposes of explanation, specific configurations and details are set forth in order to provide a thorough understanding of the embodiments. However, it will also be apparent to one skilled in the art that the present invention may be practiced without the specific details. Furthermore, well-known features may be omitted or simplified in order not to obscure the embodiment being described.

Cushions in accordance with current embodiments use single-density closed cell foam, such as EVA foam. EVA is a polymer that approaches elastomeric materials in softness and flexibility, yet can be processed like other thermoplastics. The material has good clarity and gloss, barrier properties, low-temperature toughness, stress-crack resistance, hot-melt adhesive water proof properties, and resistance to UV radiation. EVA has little or no odor and is competitive with rubber and vinyl products in many electrical applications. Although EVA foam is one type of closed cell foam that can be used, other closed cell foams can be used for cushions in accordance with embodiments herein. This type of foam is similar to the type of foam used to make "flip-flop" sandals and similar products. The foam has several advantages over standard polyurethane and memory foams in that it is lightweight, very durable and completely waterproof (the waterproof feature is very important for wheelchair cushions). The reason that this type of foam has not been used for wheelchair cushions is that it is not very resilient. Unlike polyurethane foams that are designed to have a lot of elasticity, the foams in cushions of current embodiments only allow a very small amount of immersion. This low level of immersion produces a response to load that is the opposite of the common foam and fluid wheelchair cushions. The lack of resiliency would not matter much if the present foam was used to produce cushions that are molded to the exact shape of the user, but the lack of compressibility does not work well with a more generic cushion configuration that requires a lot of immersion. However, a pre-contoured wheelchair cushion produced in the traditional manner but using closed cell foam instead of a polyurethane foam will not allow sufficient immersion to pass the Medicare required testing for coding as a wheelchair cushion.

Thus, in order to use single density closed-cell foam to achieve the pressure redistribution characteristics found in more traditional cushions, the design of the present cushion is dramatically different. Instead of relying on the elastic properties of the foam materials to allow immersion, the cushion itself changes shape and conforms to the load and contour of the individual user. To achieve the redistribution of pressure found in other cushion designs, applicants herein designed a cushion so that it responds to the applied load of the user by actually changing shape. To clarify, the standard polyurethane foam cushion changes shape only through compression. The closed cell cushion material in accordance with current embodiments is shaped so that it not only allows compression, but the cushion is shaped to provide a dynamic response in which it bends and flexes before receiving a full load, and thus the structure of the molded foam allows the cushion to "bend" around the applied load. Whereas pre-contoured top surfaces of other commercial wheelchair cushions may rely on both their pre-contour and compressibility to achieve their pressure distribution, such cushions are not using pre-contouring, compression, and bending to achieve a dynamic redistribution of pressure away from the areas of high pressure to areas of lower pressure as in current embodiments which incorporate a pre-contoured top surface not unlike other commercial wheelchair cushions.

In addition to pressure redistribution, the dynamic bending and shaping of the cushion to a user is further beneficial for its effect on lateral stability of the pelvis. Because the substantial compressibility of other foam cushions responds to load by compressing to allow immersion, such cushions do not resist pelvic retrusion due to slouching. In contrast, since a cushion of present embodiments bends into a new shape under load and has minimal compressibility, it will provide resistance to pelvic retrusion, thereby helping maintain the spine in its natural curvature, which may prevent significant back pain from an uncorrected prolonged pelvic retrusion and straightened spine.

Figure 2:
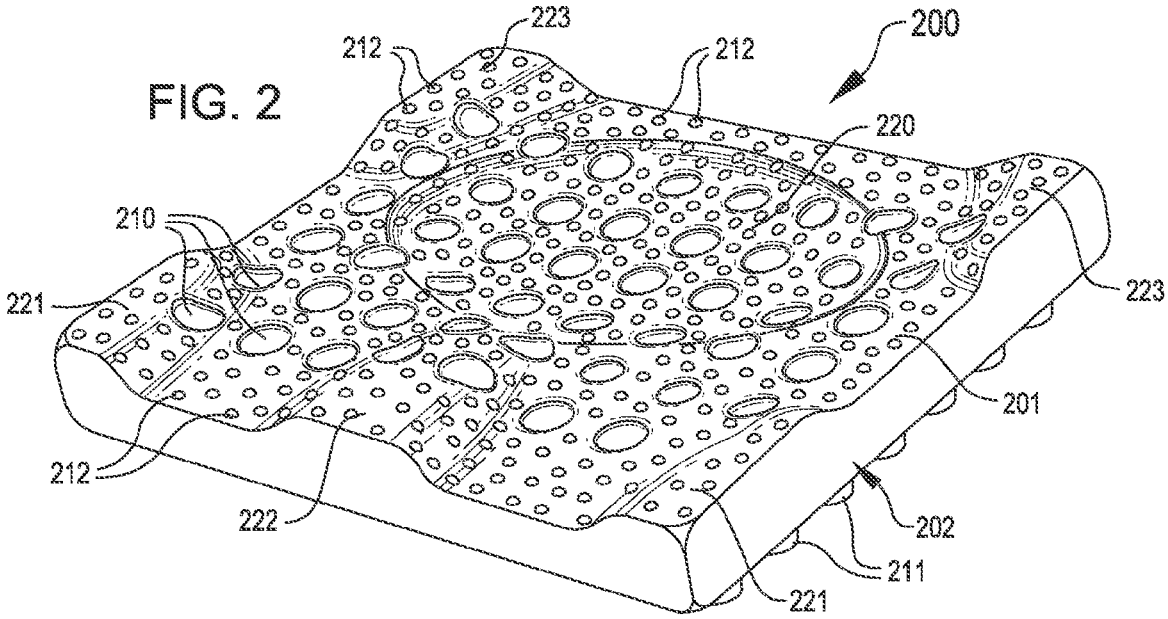
FIG. 2 is a top perspective view of a cushion in accordance with various embodiments.
Figure 3:
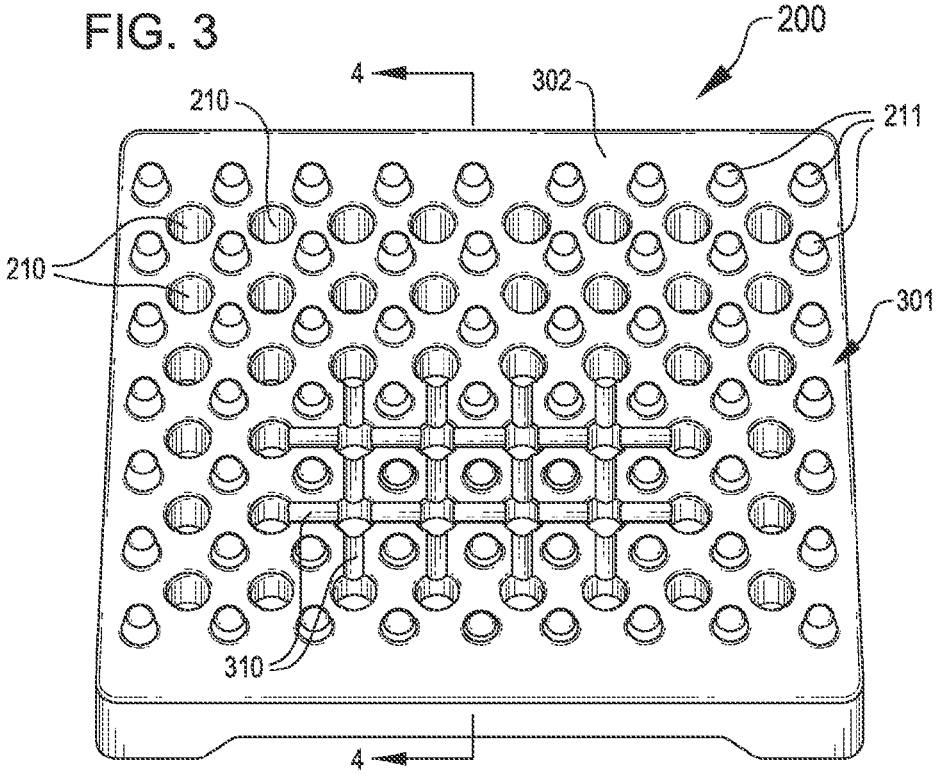
FIG. 3 is a bottom perspective view of a cushion in accordance with various embodiments.

Referring now to the drawings, in which like reference numerals represent like parts throughout the several views, FIG. 2 shows a top perspective view and FIG. 3 shows a bottom perspective view of a cushion 200 in accordance with various embodiments. The cushion 200 has a top sitting face 201 which contacts the user's body and conforms to it when the user sits on the cushion, a bottom supporting face 301 which contacts the support surface 150 at various points, and a cushion body 202 which connects the top sitting face 201 and the bottom supporting face 301. The points which contact the support surface 150 when a user sits on the cushion 200 will depend upon the weight and body shape contour of the user.

As best seen in FIG. 2, in some embodiments, the top sitting face 201 has a pre-countoured configuration which includes contoured areas formed so that the cushion, without load, is already contoured to meet the general anatomical shape of a person when in the seated position. For example, the cushion 200 can have a contoured depression or pelvic well 220 shaped for receiving the ITs 101 of a user. While the shape of this well shown in FIG. 2 is elliptical, the well 220 can be any other shape, including, but not limited to, both shapes that are symmetrical (such as circles, triangles, squares, and other common polygons) and shapes that are not symmetrical (e.g. with a left side of the shape larger or otherwise shaped differently from a right side, a front part of the shape larger or otherwise shaped differently from a back side, or any other non-matching combination of parts). The cushion can also have outer or lateral thigh ridges 221 for aligning and supporting the thighs of a user from a lateral position. These outer thigh ridges 221 also can be shaped alike or shaped differently. The cushion can also have one or more inner or medial thigh ridges 222 at the front of the cushion for aligning and supporting the thighs of a user from a medial position. These inner thigh ridges 222 also can be shaped alike or shaped differently. The cushion can also have one or more buttocks or lateral hip ridges 223 at the back of the cushion for aligning and supporting the buttocks and/or lateral hip portions of a user in a seated position. These buttocks ridges 223 also can be shaped alike or shaped differently. As may be appreciated in FIGS. 1B and 5, such general contours can also provide additional support to a user's body to supplement the resistance to pelvic retrusion provided by the dynamic bending and shaping response of cushion 200, thereby assisting in orienting the spine 110 toward its natural curvature.

In various embodiments, the dynamic bending and shaping response to load of cushion 200 is accomplished by special configuration of ventilation holes such as port 210 and spacing members such as pillar 211. Standard port and pillar technology is described in U.S. Pat. No. 7,695,069, entitled "Seat Cushion", and incorporated herein by reference.

Figure 4:
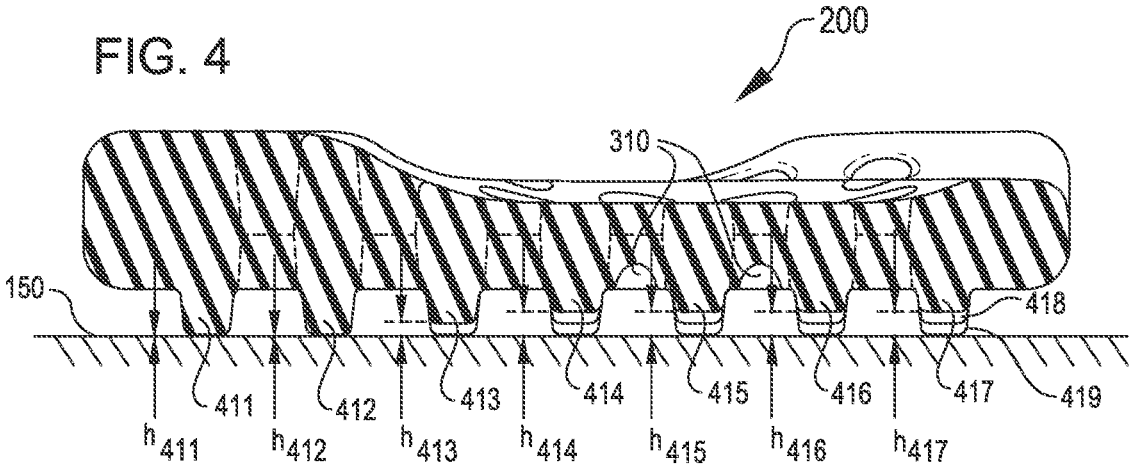
FIG. 4 is a section view of a cushion in accordance with various embodiments.

As part of the special configuration, support pillars on the cushion 200 are of different heights on supporting face 301 (e.g., in the embodiment shown in FIG. 4, pillars 411 and 412 are each taller than each of pillars 413-417). The supporting face 301 includes a bottom 302 of the body 202 which is generally flat, with these pillars attached to this flat bottom 302. Thus, in an unloaded state of cushion 200, not all pillars contact the support surface 150 on which the cushion 200 is placed (e.g., in the embodiment shown in FIG. 4, each of pillars 413-417 have a nonzero height—$h_{413}$-$h_{417}$, respectively—of the distance between the bottom of the pillar and the support surface 150, while pillars 411 and 412 have $h_{411}=h_{412}=0$ because each is touching the support surface 150).

Figure 5:
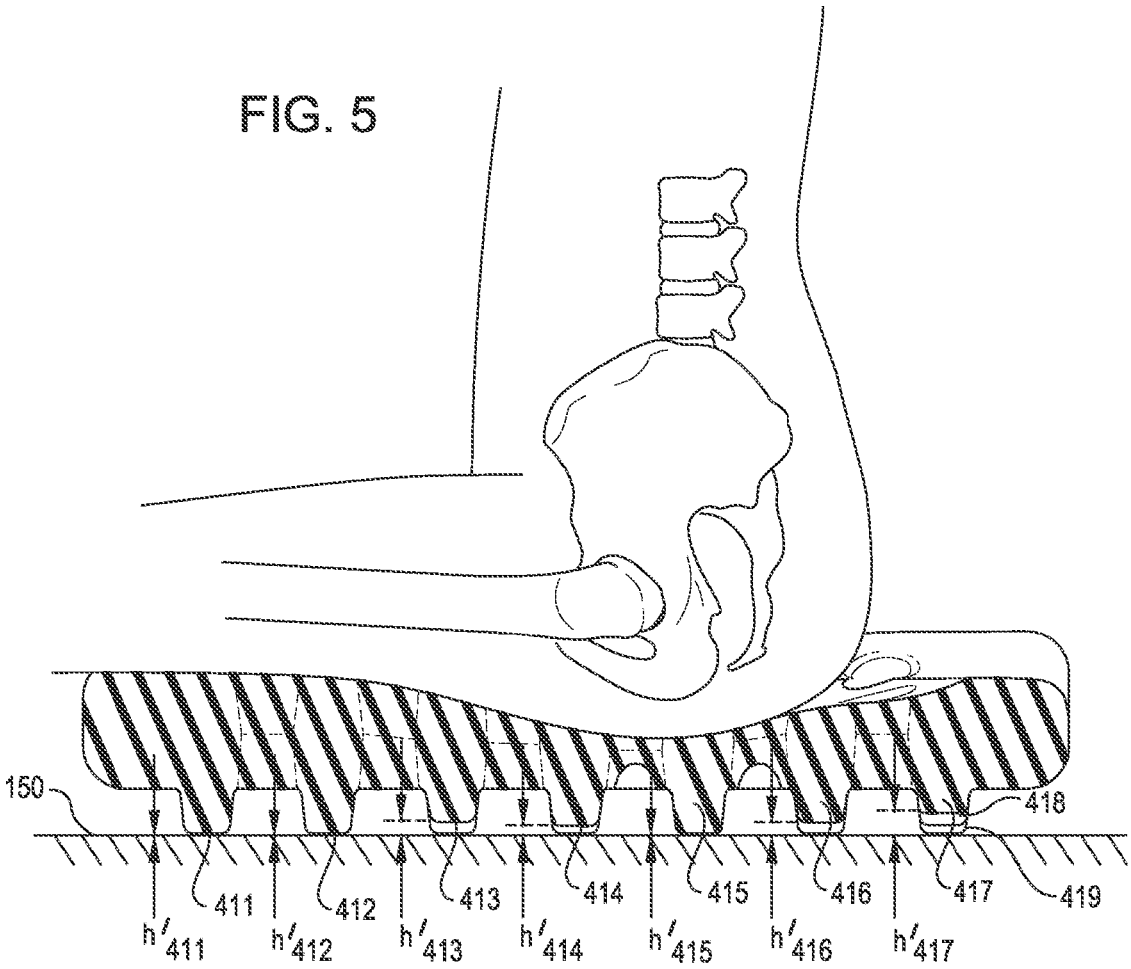
FIG. 5 is a section view of a cushion supporting a person in accordance with various embodiments.

However, in embodiments, as the cushion 200 receives a load, the cushion 200 bends so that some of the shorter pillars are moved closer to the support surface 150 (e.g. in the embodiment shown in FIG. 5, pillars 413-416 are moved such that each of $h'_{413}$-$h'_{416}$ is less than each of $h_{413}$-$h_{417}$, repectively). Among those pillars, some may be pressed down into contact with the surface 150 (e.g., in the embodiment shown in FIG. 5, for pillar 415 $h'_{412}=0$). It is also possible that other pillars will not move relative to supporting surface 150 at all (e.g., in the embodiment shown in FIG. 5, for pillar 417, $h'_{417}=h_{417}$). Thus the cushion 200 bends and flexes under the particular load and contour of the user's body to provide an additional contouring of the cushion over prior art cushions, which helps to distribute the load more appropriately to high pressure areas on the user's body.

As may be appreciated from FIG. 5, the amount of bending and the determination of which pillars will actually contact the support surface when a user is supported by cushion 200 will both depend on the specific weight and body contour specifics of the user as well as the configuration of pillar height of the particular embodiment. Thus, the height selected for pillars on the supporting face 301 may be varied individually or as part of a larger pattern in order to create different embodiments of cushion 200 for different users or groups of users. For example, in embodiments such as that shown in FIG. 4, the pillars on the cushion are very short underneath the pelvic well 220 and gradually become longer as the cushion contours travel out toward an area for supporting the trochanteric shelf 104 of a user and forward toward the front of the cushion 200. As described earlier, the ischial area 101 is first to contact the cushion. A pattern may also vary height in a lateral direction, as best seen in the embodiment of FIG. 4, wherein short pillar 417 may be seen in front of medium pillar 418 and tall pillar 418.

As may be best seen in FIG. 3, in embodiments, the cushion 200 can also have troughs 30 on the supporting face 301 to make the cushion 200 bend and flex more easily. In many embodiments, the troughs 310 are rounded and run between the pillars to provide areas of strain relief by decreasing surface tension on the supporting face 301 of cushion 200, thereby lowering the force needed to cause the cushion 200 to bend and flex in response to load and decreasing the need for the supporting face 301 to stretch in those areas. The troughs 310 can be arranged in a column and row pattern. The cushion 200 can have troughs 310 between all or only some of the rows, and the troughs 310 may extend from one edge of cushion 200 to the other, or may only be positioned in selected locations. In some embodiments, the troughs 310 only run between the shortened pillars on the supporting face 301 of the cushion 200. The troughs can also be positioned only in locations of maximum surface tension, or can extend over the entirety of the cushion, or any subset thereof. For example, as shown in the embodiment of FIG. 3, the supporting face 301 of the cushion 200 has rounded troughs 310 in a column and row pattern only under the pelvic well 220 of the cushion 200.

As best shown in FIG. 2, cushion 200 may also include a plurality of nubs 212 spread out across the sitting face 201. These nubs 212 can provide a desirable additional tactile characteristic to cushion 200 and are thought to stimulate nerve activity and improved blood circulation in the portion of a person's body placed in contact with them. Additionally, the nubs 212 may be included to improve performance of a cushion cover (not shown). For example, if a cushion cover is placed over a cushion 200, when a user is not pressing the fabric of the cover into the cushion seating face 201 by sitting on it, the nubs may provide sufficient separation between the cushion cover and the cushion 200 so as to provide airflow there between to allow more rapid cooling or drying of the cover due to increased airflow and convection.

Any suitable method of manufacturing or fabricating the cushion 200 can be used. For example, in some embodiments, the cushion 200 may be formed in two general sections, a top section and a bottom section, where the top section is a perforated core which is molded onto the lower section made up of pillars with different heights. In some embodiments, the cushion 200 is injection molded as one piece, including the pillars 211. In addition, if desired, voids can be added to selective sections of the cushion 200 to aid in molding, the reduce the amount of mold material used, and/or to provide selective flexibility of the cushion.

Furthermore, the cushion 200 can be adapted for a variety of uses. While many embodiments herein describe the cushion adapted for use in a wheelchair to prevent pressure sores, the cushion 200 can be used in any situation where a person will be sitting or in any situation where a person may support even a portion of their weight or a body part relative to a support surface. Examples include, but are not limited to, use of the cushion with office chairs, home furniture, stool, automobiles, trains, airplanes, boats, tractors, motorcycles, bicycles, unicycles, tricycles, recreational vehicles, dune buggies, jet skis, stadium seats, spacecraft, hovercraft, ski lifts, roller coaster, glider, luge, bobsled, recliners, gurneys, beds, yoga mats, pet crate liners, gardening knee mats, or any other kind of cycle, vehicle, seat, or furniture.

Other variations are within the spirit of the present invention. Thus, while the invention is susceptible to various modifications and alternative constructions, certain illustrated embodiments thereof are shown in the drawings and have been described above in detail. It should be understood, however, that there is no intention to limit the invention to the specific form or forms disclosed, but on the contrary, the intention is to cover all modifications, alternative constructions, and equivalents falling within the spirit and scope of the invention, as defined in the appended claims.

The use of the terms "a" and "an" and "the" and similar referents in the context of describing the invention (especially in the context of the following claims) are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. The term "connected" is to be construed as partly or wholly contained within, attached to, or joined together, even if there is something intervening. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate embodiments of the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

All references, including publications, patent applications, and patents, cited herein are hereby incorporated by reference to the same extent as if each reference were individually and specifically indicated to be incorporated by reference and were set forth in its entirety herein.

What is claimed is:

1. A seat cushion for supporting at least a portion of a user relative to a support surface, the cushion comprising:

material with sufficient flexibility for the cushion to deform from an unloaded configuration toward a loaded configuration as a weight of the user is placed on the cushion, and with sufficient resilience for the cushion to return toward an unloaded configuration as the weight of the user is removed from the cushion, and with sufficient stiffness that the cushion deforms predominantly by bending as a load is applied;

a body;

a sitting face on a top side of the body, the sitting face configured to contact portions of the body of the user when supported by the cushion and comprising a contour configured to match a generic anatomical shape of a seated user and configured to aid in positioning the seated user in a therapeutically optimal position; and a supporting face on an under side of the body and characterized by a plurality of points, the supporting face contoured such that when the cushion is in the unloaded configuration a first subset of the plurality of points contact the support surface and a second subset of the plurality of points do not contact the support surface, and when the cushion is in the loaded configuration at least some of the points in the second subset contact the support surface, the second subset of the plurality of points further being positioned below the contour of the sitting face such that pelvic retrusion of the seated user is mitigated.

2. The seat cushion of claim 1, wherein the supporting face further comprises a plurality of pillars, each pillar having a top end connected to the body of the cushion and a bottom end corresponding to one of the plurality of points, wherein the pillars corresponding to the second subset are shorter than the pillars corresponding to the first subset.

3. The seat cushion of claim 2, wherein the pillars corresponding to the second subset are shortest underneath an area of the cushion for receiving ischial tuberosities of the user and increase in height as pillar placement on the supporting face moves away from an area of the cushion for receiving ischial tuberosities of the user.

4. The seat cushion of claim 1, wherein the cushion body, sitting face, and supporting face are made of one piece by injection molding.

5. The seat cushion of claim 1, wherein the material is single density, closed-cell foam.

6. The seat cushion of claim 1, wherein the contour further comprises a recessed area configured to receive a pelvis and coccyx of the user.

7. The seat cushion of claim 1, wherein the contour further comprises elevated components to support and orient thighs and hips of the user.

8. The seat cushion of claim 2, wherein the supporting face further comprises troughs in a bottom of a body of the seat cushion between pillars on the supporting face such that surface tension on the supporting face is decreased to lower a magnitude of a force needed for bending or compressing the cushion near the troughs.

9. The seat cushion of claim 8, wherein the troughs are rounded.

10. The seat cushion of claim 8, wherein the troughs are positioned in a row and column pattern.

11. The seat cushion of claim 8, wherein the troughs are positioned only in locations of maximum surface tension.

12. The seat cushion of claim 8, wherein the troughs extend over the entirety of the supporting face.

13. The seat cushion of claim 2, wherein the cushion further comprises ports, the ports providing openings extending through the seating face, the body, and the supporting face.

14. The seat cushion of claim 1, wherein the sitting face further comprises a plurality of nubs protruding from the sitting face.

* * * * *